US006009183A

United States Patent [19]

Taenzer et al.

[11] Patent Number: 6,009,183

[45] Date of Patent: Dec. 28, 1999

[54] AMBIDEXTROUS SOUND DELIVERY TUBE SYSTEM

[75] Inventors: Jon C. Taenzer, Los Altos; Patrick A. Mavrakis, Newark; George V. Anastas, San Carlos, all of Calif.; Gary M. Rapps, Sunrise, Fla.

[73] Assignees: Resound Corporation, Redwood City, Calif.; Motorola, Inc., Schaumburg, Ill.

[21] Appl. No.: 09/107,605

[22] Filed: Jun. 30, 1998

[51] Int. Cl.[6] ..... H04R 25/00

[52] U.S. Cl. ..... 381/330; 381/380; 381/382; 181/129

[58] Field of Search ..... 381/330, 381, 381/60, 322, 324, 327, 328, 380, 382; 181/129, 130, 135; 379/430

[56] References Cited

U.S. PATENT DOCUMENTS

| | | | |
|---|---|---|---|
| 3,297,832 | 1/1967 | Brown | 381/327 |
| 3,536,861 | 10/1970 | Dulavy . | |
| 3,975,599 | 8/1976 | Johanson . | |
| 3,983,336 | 9/1976 | Malek et al. . | |
| 4,090,040 | 5/1978 | Berland . | |
| 4,296,829 | 10/1981 | Pedersen | 381/330 |
| 4,381,830 | 5/1983 | Jelonek et al. | 381/330 |
| 4,450,930 | 5/1984 | Killion . | |
| 4,751,738 | 6/1988 | Widrow et al. . | |
| 4,864,610 | 9/1989 | Stevens | 381/381 |
| 4,869,339 | 9/1989 | Barton . | |
| 4,904,078 | 2/1990 | Gorike . | |
| 5,031,219 | 7/1991 | Ward et al. . | |
| 5,033,090 | 7/1991 | Weinrich et al. . | |
| 5,113,967 | 5/1992 | Killion et al. . | |
| 5,201,006 | 4/1993 | Weinrich . | |
| 5,201,007 | 4/1993 | Ward et al. . | |
| 5,276,739 | 1/1994 | Krokstad et al. . | |
| 5,278,912 | 1/1994 | Waldhauer . | |
| 5,488,205 | 1/1996 | Major . | |
| 5,488,668 | 1/1996 | Waldhauer . | |
| 5,500,902 | 3/1996 | Stockhan, Jr. et al. . | |
| 5,524,056 | 6/1996 | Killion et al. . | |

*Primary Examiner*—Huyen Le
*Attorney, Agent, or Firm*—Burns, Doane, Swecker & Mathis, L.L.P.

[57] ABSTRACT

A sound delivery system such as a hearing aid, a telephone headset, a multimedia headset, or other communications device is capable of being used on either the left or right ear of the user. The sound delivery system includes an integral case and ear hook having a rotatable connection for receiving a sound delivery tube. The sound delivery tube is preformed in a generally L-shaped tube. The sound delivery tube has an eartip at one end configured to be received in the ear canal of the user to secure the end of the sound delivery tube in the ear canal. The tube can be rotated about an axis between a left-ear position and a right-ear position.

14 Claims, 4 Drawing Sheets

AMBIDEXTROUS SOUND DELIVERY TUBE SYSTEM

BACKGROUND OF THE INVENTION

1. Field of the Invention

The invention relates to a sound delivery system, such as a hearing aid, a communication device, or a multimedia device, and more particularly, the invention relates to an ambidextrous sound delivery tube system for delivery of sounds to the ear canal of a user.

2. Brief Description of the Related Art

Sound delivery systems such as hearing aids, telephone headsets, radio headsets, and other communications and sound transmitting systems may be utilized to deliver sounds directly to the ear canal of the user. Such sound delivery systems include those two-way communication systems worn by police, firefighters, secret service agents, and the like to receive sound transmissions from a remote location and transmit sound to the remote location. Other sound delivery systems include the class of hearing aids which are used by the hearing impaired to amplify and process sounds. Traditional hearing aids include "behind the ear" (BTE) hearing aid devices which are attached behind the ear of the user.

The BTE hearing aid devices and other sound delivery systems may include a flexible plastic tube connecting a sound receiving device mounted behind the ear to an ear-mold eartip positioned within the ear canal. In the case of a hearing aid, the receiving device may include a microphone, an amplifier, processing circuitry, and a speaker. In the case of a sound transmission system, the receiving device includes a receiver or speaker, and processing circuitry.

The tubes for transmitting sound from the case behind the ear to the eartip are generally transparent tubes secured on one end to the case and on the other end to the eartip. The tubes may be either flexible tubes or rigid tubes formed in a preformed shape. With a flexible tube, the eartip must hold the end of the tube securely within the ear canal because the tube itself provides little or no support to the eartip to hold the end of the tube in the ear. Eartips which are used with these flexible tubes are generally custom made devices which conform to the ear canal shape and secure the sound delivery end of the tube in the ear canal. With a more rigid tube having a preformed shape, a wide variety of eartips can be used which are partially held in place in the ear canal by the rigidity of the tube. Examples of preformed tubes are described in U.S. Provisional Patent Application Ser. No. 60/053,031, filed Jul. 18, 1997, which is incorporated herein by reference in its entirety. With this rigid tube construction, tubes are made in different sizes to fit different ear sizes and are provided in left and right ear configurations.

Hearing aids are conventionally fitted to a left or right ear of a patient and are not switched between the left and right ears. However, sound delivery devices which are used by police and fire departments for communication or sound delivery devices used for multimedia applications may be used in either the left or right ear of the user. Thus, it would be desirable to provide an ambidextrous sound delivery device which may be used behind either the left or right ear of a user.

In addition, when a sound delivery device is used by different people it would be desirable to have a replaceable and disposable ear tube and/or eartip.

SUMMARY OF THE INVENTION

The present invention relates to an ambidextrous sound delivery system having the ability be easily switched between left ear and right ear configurations.

In accordance with one aspect of the present invention, an ambidextrous sound delivery system includes, a case symmetrically configured to be placed behind the left or right ear of a user, sound receiving and processing circuitry within the case, a sound output port on the case, and an ambidextrous sound delivery tube. The sound delivery tube has a first end for connection to the sound output port and a second end for connection to an eartip. The tube is preformed in a substantially L-shape which can be used in the left or right ear of the user. A rotatable coupling is provided between the sound output port and the sound delivery tube to allow the sound delivery tube to be rotated with respect to the case to allow the system to be used on either the left or right ear of the user.

In accordance with an additional aspect of the present invention, the ambidextrous sound delivery system includes a case for containing sound processing circuitry configured to be received behind either the left or right ear of a user, an ear hook extending from the case in a curved shape which extends over the ear of the user, a sound output port of the ear hook having an axis oriented directly at a tragal notch and ear canal entrance of a user when the case is received behind either the left or right ear, and a coupling of the sound output port for receiving a sound delivery tube in a first position for use on a right ear and in a second position for use on a left ear.

BRIEF DESCRIPTION OF THE DRAWINGS

The invention will now be described in greater detail with reference to the preferred embodiments illustrated in the accompanying drawings, in which like elements bear like reference numerals, and wherein.

DETAILED DESCRIPTION OF THE PREFERRED EMBODIMENTS

Figure 1:
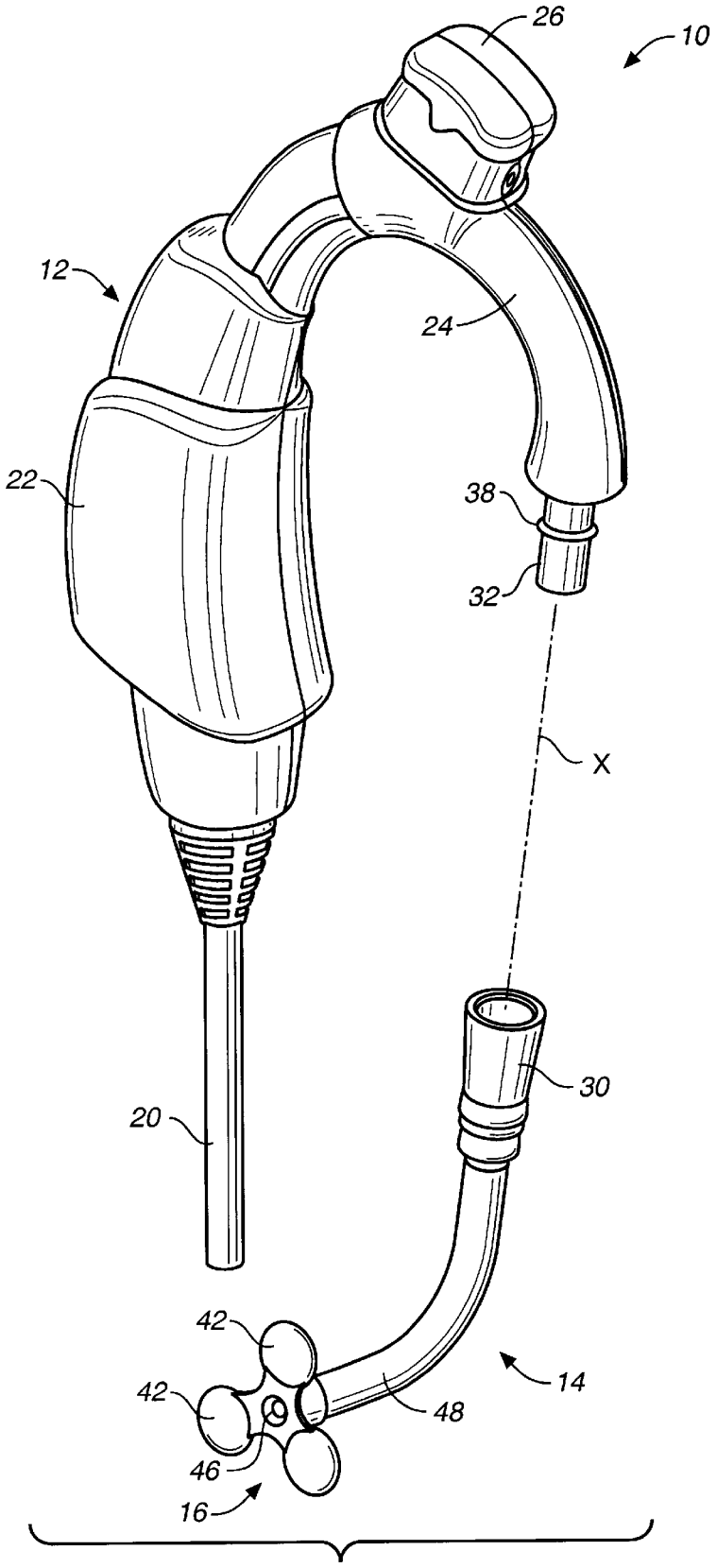
FIG. 1 is a partially exploded perspective view of an ambidextrous sound delivery device according to the present invention.
Figure 2:
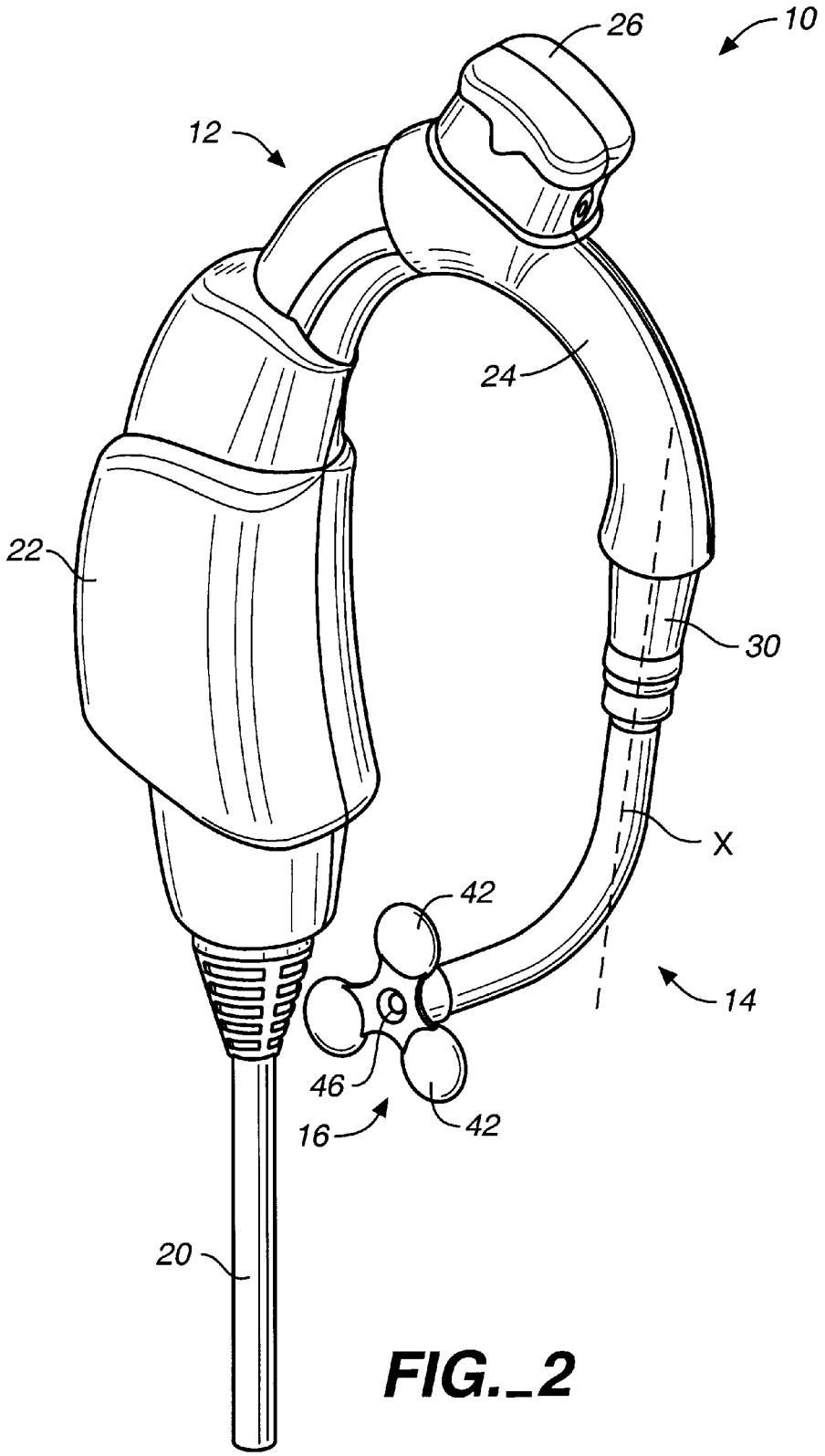
FIG. 2 is an assembled perspective view of the sound delivery device of FIG. 1 with the sound delivery tube in a left ear position.
Figure 3:
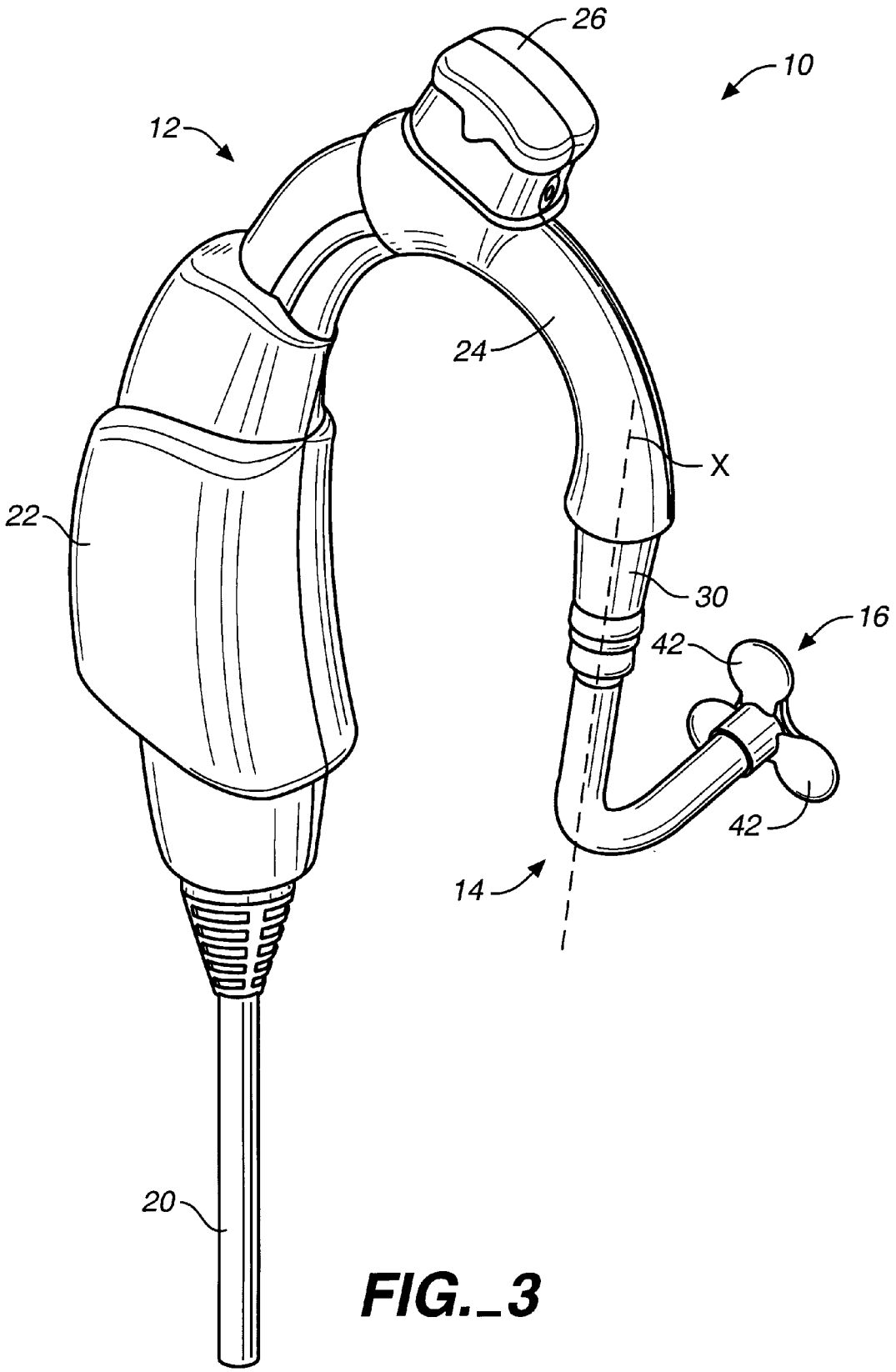
FIG. 3 is an assembled perspective view of the sound delivery device of FIG. 1 with the sound delivery tube in a right ear position.

A sound delivery system 10 for delivering sound to the ear canal of the user, as shown in the exploded perspective view of FIG. 1, includes a body 12, a sound delivery tube 14, and an eartip 16. The sound delivery tube 14 is rotatable about an axis X between a first position illustrated in FIG. 2 for use on the left ear of the user to a second position illustrated in FIG. 3 for use on a right ear on the user.

The sound delivery system body 12 as shown in FIG. 1 includes a cable 20 for electrical connection to a communication device such as a telephone, multimedia device, or other transmitting and/or receiving device. The communication device to which the sound delivery system 10 is connected by the cable 20 may be a fixed device or a portable device which may be worn on the person. Although the invention has been illustrated with a cable 20 for connection to external electronics, the cable may be omitted for certain devices and a wireless link may be used.

Alternatively, for a hearing aid device, the electronics may be entirely contained within the body 12. The body 12 includes a case portion 22 containing appropriate sound receiving and processing circuitry for a particular application. For example, the case portion 22 may contain a sound processing circuit and a receiver. The case portion 22 is configured to be received and concealed behind the ear of the user and is substantially symmetrical about a central plane containing the axis X so that it can be received behind either the left or right ear. An ear hook portion 24 of the body 12 extends from the case portion 22 and curves over the ear of the user. The ear hook portion 24 supports the body 12 securely on the user's ear. A sound transmission tube (not shown) within the ear hook transmits sound from a receiver or speaker within the body to the sound delivery tube 14.

When the ambidextrous sound delivery system 10 according to the present invention is used as a communications device, a microphone 26 may be mounted on an upper surface of the ear hook portion 24. The microphone 26 picks up sounds and allows the sound to be transmitted by the sound delivery system back to a remote location or processed for use by the hearing impaired user.

Figure 4:
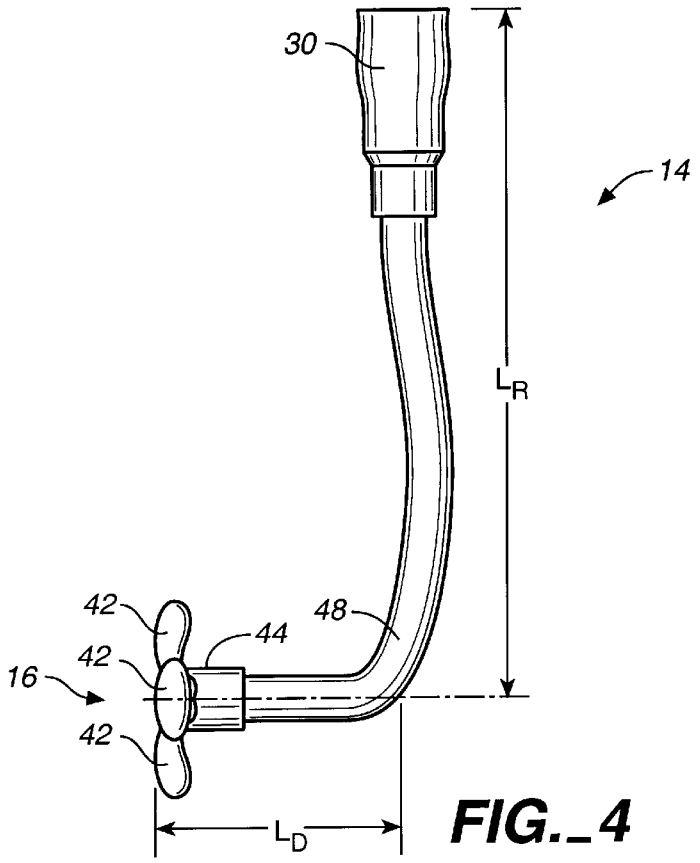
FIG. 4 is a side cross-sectional view of an ambidextrous sound delivery tube and eartip.

An enlarged side view of the sound delivery tube 14 and eartip 16 is shown in FIG. 4. The sound delivery tube 14 includes a connector 30 at a first end of the sound delivery tube and the eartip 16 at a second end of the sound delivery tube. The connector 30 is received on a sound output port 32 which extends from the ear hook portion 24 of the body 12. The connector 30 and sound output port 32 together form a rotatable, snap-fit coupling between the body 12 and the sound delivery tube 14.

Figure 5:
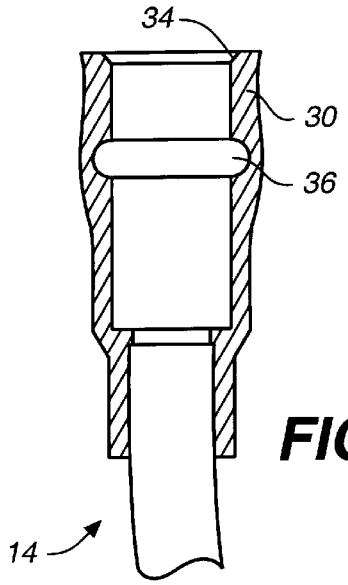
FIG. 5 is a side cross-sectional view of a sound delivery tube connector.

As illustrated in the cross-sectional view of FIG. 5, the connector 30 includes an internal beveled surface 34 at an edge of the connector for ease of insertion of the sound output port 32. The connector 30 also includes an annular groove 36 with a hemispherical cross-section for receiving an annular ring 38 of the sound output port 32. The annular groove 36 and annular ring 38 provide a secure snap-fit rotatable coupling between the sound delivery tube 14 and body 12. The connector 30 is formed of a resilient material which stretches over the sound output port 32 to provide a substantially air tight fit. Other types of rotatable couplings with one or more grooves and correspondingly shaped rings may also be used.

The snap-fit coupling allows the sound delivery tube 14 and the eartip 16 to be easily removed from the body 12 and replaced. A disposable sound delivery tube 14 is particularly advantageous for applications where multiple users use the same device. For example, police and fire departments may provide a supply of disposable sound delivery tubes 14 for use with the device. In addition, the snap-fit coupling allows the sound delivery tube 14 to be periodically replaced for sanitation purposes.

Although the present invention has been described as including a connector 30 of the sound delivery tube 14 which snaps over the sound output port 32, it should be understood that an ear tube connector may alternatively be fitted inside a sound output port of the body 12 to provide an air tight rotatable coupling. Further, the coupling may be any type of coupling which has at least two positions. For example, a non-rotatable coupling may be provided which has two snap in positions at which the tube is secured by notches or keys within the coupling.

As illustrated in FIG. 4, the sound delivery tube 14 is substantially L-shaped and lies substantially in a plane. The sound delivery tube 14 has a run length $L_R$ between the end of the connector 30 and the lowest part of the tube where the tube bends to enter the ear canal. A distance between the point where the tube bends to enter the ear canal and an end of the eartip 16 is called a duck-in-length $L_D$. The tube is preferably formed of a soft rubbery material having sufficient resilience to return the tube to the L-shape when the tube is not subject to external forces. The flexibility of the sound delivery tube material allows one size tube to fit substantially all ear shapes and sizes.

A distance between a top of a user's ear where the ear hook portion 24 rests and the ear canal varies somewhat between users. However, the horizontal portion of the tube 14 will flex up or down to accommodate slight differences in this ear dimension. In addition, ear canal depths vary by approximately ±⅛ inch (3.2 mm) between users. These variations in ear canal depth can be accommodated by allowing the eartip 16 to enter the canal to different depths or allowing the bend 48 of the tube to extend further out of the ear canal into the bowl or concha of the ear.

According to an alternative embodiment of the invention, the sound delivery tube 14 may be formed of a more rigid material. A rigid sound delivery tube 14 may be provided in different sizes with the run lengths $L_R$ and duck-in-lengths $L_D$ varying for different users.

The eartip 16 illustrated in the figures is a flower-shaped eartip formed of a resilient material which includes three flower petals 42 extending from a base 44. A sound output opening 46 is provided at the center of the flower-shaped eartip 16 for delivering sound from the sound delivery system 10 to the ear canal. The eartip 16 retains the end of the sound delivery tube 14 in position within the user's ear canal by engaging the walls of the ear canal with the resilient petals 42 of the flower. The flower-shaped eartip 16 is only one example of an eartip which may be used with the present invention. Many other eartip shapes may also be used including the bud-shaped and guppy-shaped eartips illustrated in U.S. Provisional Patent Application Ser. No. 60/053,031 filed on Jul. 18, 1997, which is incorporated herein by reference in its entirety. Other shapes and constructions of custom earmold eartips and stock eartips may also be connected to the sound delivery tube 14 according to the present invention.

The present invention provides a sound delivery system 10 which can be easily worn on either side of the head and can be quickly configured between left-ear and right-ear orientations. The snap-fit connection also allows quick and easy replacement of the sound delivery tube 14 and ear tip 16.

The ability to switch between left-ear and right-ear orientations is provided by the particular shape and orientation of the sound delivery tube 14 and the ear hook portion 24 of the body 12, as well as the rotatable coupling. In particular, the orientation of the longitudinal axis X of the rotatable coupling allows the horizontal portion of the sound delivery tube 14 to be properly received in the ear canal.

The sound delivery system 10 is particularly designed with the sound output port 32 of the body 12 oriented such that its longitudinal axis X extends directly toward the ear canal entrance via the tragal notch of the ear. This allows the sound delivery tube 14 to be constructed to include only a single bend 48 and to lie substantially in a single plane. Switching between the left-ear and right-ear orientation involves rotating the sound delivery tube 14 about 165 to 195 degrees, preferably about 180 degrees with respect to the body 12. The flower-shaped eartip 16 with its multiple resilient petals 42 allows the horizontal portion of the tube to enter the ear canal at slightly different angles.

The rotatable coupling between the body 12 and sound delivery tube 14 is designed to provide a substantially air tight acoustic seal. The acoustic seal is provided by the elastic properties of the sound delivery tube 14 which stretches over the sound output port 32. In addition, the annular ring 38 on the sound output port 32 and the annular grove 36 of the sound delivery tube 14 form a labyrinth which makes air leakage through the coupling difficult and further improving the acoustic seal. The rotatable connection preserves the high sound delivery quality for delivery to the ear canal.

Acoustic impedance throughout the length of the rotatable connection is maintained constant by providing a constant inner diameter of the sound transmission pathway. In particular, an internal diameter of the sound output port 32 is substantially the same as an internal diameter of the sound delivery tube 14. The connector 30 is designed to align the inner diameter of the sound output port 32 and the inner diameter of the sound delivery tube 14 with minimal acoustic interference. Thus, the sound carried from the body 12 to the tube 14 is not reflected by any imperfections or inconsistencies inside the tubing which may create standing waves at the tubing junction.

Preferably, the sound delivery tube 14 is formed of a relatively rigid material which when assembled and fitted on the ear of a user with the eartip 16 inside the ear canal helps to secure the sound delivery system in place. The sound delivery tube 14 may be formed of any suitable material such as plastic, silicone rubber, or the like. However, when the sound delivery system 10 is to be used by firefighters in fire-fighting applications, the sound delivery tube 14 should be formed of a material which does not melt at high temperatures which may be encountered. For example, silicone rubber is a thermosetting material which, once cured, does not melt or soften. The entire sound delivery tube 14, connector 30, and eartip 16 may be molded together as a single piece from a single material. Alternatively, the connector 30 and eartip 16 may be connected to the sound delivery tube 14 by over-molding, adhesive, snap-fit connections, or the like.

While the invention has been described in detail with reference to the preferred embodiments thereof, it will be apparent to one skilled in the art that various changes and modifications can be made and equivalents employed, without departing from the present invention.

What is claimed is:

1. An ambidextrous sound delivery system comprising:

a case symmetrically configured to be placed behind the left or right ear of a user;

sound receiving and processing circuitry within the case;

an ear hook portion of the case configured to extend over a top of the ear and support the case on the ear;

a sound output port on the ear hook portion of case;

an ambidextrous sound delivery tube having a first end for connection to the sound output port and a second end for delivering sound to an ear canal, the tube preformed in a substantially L-shape which can be used in the left or right ear of the user; and a rotatable coupling between the sound output port and the sound delivery tube to allow the sound delivery tube to be rotated with respect to the case to allow the system to be used on either the left or right ear of the user.

2. The ambidextrous sound delivery system of claim 1, wherein the rotatable coupling includes a first tubular connector of the sound output port and a second tubular connector on the first end of the sound delivery tube, wherein the second tubular connector is positioned around and provides a sound transparent acoustic seal with the first tubular member.

3. The ambidextrous sound delivery system of claim 1, wherein the ambidextrous sound delivery tube is molded in the preformed substantially L-shape from silicone rubber.

4. The ambidextrous sound delivery system of claim 1, further comprising an eartip connected to the second end of the sound delivery tube for retaining the second end of the sound delivery tube in the ear canal.

5. The ambidextrous sound delivery system of claim 4, wherein the sound delivery tube and the eartip are molded in one piece.

6. The ambidextrous sound delivery system of claim 1, wherein the sound delivery tube and a tubular connector of the rotatable coupling are molded in one piece.

7. The ambidextrous sound delivery system of claim 1, wherein the sound delivery tube includes only a single bend.

8. The ambidextrous sound delivery system of claim 1, wherein the rotatable coupling has an assembled inner diameter which is the same as an inner diameter of the sound output port and an inner diameter of the sound delivery tube.

9. The ambidextrous sound delivery system of claim 1, wherein a center line of the sound delivery tube lies entirely in a single plane.

10. The ambidextrous sound delivery system of claim 1, wherein the rotatable coupling is a snap-fit coupling and the sound delivery tube is disposable.

11. An ambidextrous sound delivery system comprising:

a case symmetrically configured to be placed behind the left or right ear of a user;

sound receiving and processing circuitry within the case:

a sound output port on the ear hook portion of case, the sound output port having a longitudinal axis which is oriented directly at a tragal notch and ear canal entrance of a user when the case is positioned behind either the left or right ear of the user;

an ambidextrous sound delivery tube having a first end for connection to the sound output port and a second end for delivering sound to an ear canal, the tube preformed in a substantially L-shape which can be used in the left or right ear of the user; and a rotatable coupling between the sound output port and the sound delivery tube to allow the sound delivery tube to be rotated with respect to the case to allow the system to be used on either the left or right ear of the user.

12. An ambidextrous sound delivery system comprising:

a case for containing sound processing circuitry configured to be received behind either the left or right ear of a user;

an ear hook extending from the case in a curved shape which extends over the ear of the user;

a sound output port of the ear hook having an axis oriented directly at a tragal notch and ear canal entrance of a user when the case is received behind either the left or right ear; and a coupling of the sound output port for receiving a sound delivery tube in a first position for use on a right ear and in a second position for use on a left ear, wherein the sound deliver tube is an ambidextrous sound delivery tube having an L-shaped with a first end arranged to be connected to the coupling and a second end having an eartip configured to be received within an ear canal of the user.

13. The ambidextrous sound delivery system of claim 12, wherein the coupling is a rotatable coupling.

14. The ambidextrous sound delivery system of claim 12, wherein the first position is between about 165 degrees and 195 degrees from the second position.

* * * * *